United States Patent [19]

Yosinski

[11] Patent Number: 5,023,541

[45] Date of Patent: Jun. 11, 1991

[54] POWER SUPPLY CONTROL CIRCUIT HAVING CONSTANT VOLTAGE AND CONSTANT CURRENT MODES

[75] Inventor: Neil J. Yosinski, Johnsonburg, N.J.

[73] Assignee: Hewlett-Packard Company, Palo Alto, Calif.

[21] Appl. No.: 498,322

[22] Filed: Mar. 23, 1990

[51] Int. Cl.[5] ..... G05F 1/563

[52] U.S. Cl. ..... 323/275; 323/277; 323/280

[58] Field of Search ..... 323/275, 276, 277, 278, 323/279, 280

[56] References Cited

U.S. PATENT DOCUMENTS

| | | | |
|---|---|---|---|
| 3,414,803 | 12/1968 | Glasgow et al. | 323/275 |
| 3,536,987 | 10/1970 | Muchnick | 323/275 |
| 4,012,683 | 3/1977 | Nercessian | 323/275 |
| 4,442,397 | 4/1984 | Ishikawa et al. | 323/275 |
| 4,816,740 | 3/1989 | Maier | 323/275 |
| 4,933,625 | 6/1990 | Hayakawa | 323/275 |

*Primary Examiner*—Peter S. Wong

*Attorney, Agent, or Firm*—Frank R. Perillo

[57] ABSTRACT

A power supply control circuit which enables the constant current and constant voltage feedback loops to be compensated independent of each other. In accordance with the invention, an inner feedback loop has been added which is local to the output stage so as to allow a constant voltage feedback loop to see a closed loop transfer function of the inner feedback loop that mimics an output for a constant voltage preferred output stage even though a constant current preferred output stage is used. As a result, load impedance variations that would have affected the loop gain of the constant voltage feedback loop affect the loop gain of the inner feedback loop only. The inner feedback loop is disposed such that it is automatically disabled by the constant current feedback loop when the power supply enters the constant current mode and hence allows the constant current and constant voltage modes to be decoupled from one another. The inner feedback loop of the invention may also be disposed within the constant current feedback loop so as to allow independent mode operation for a constant voltage preferred output stage.

14 Claims, 3 Drawing Sheets

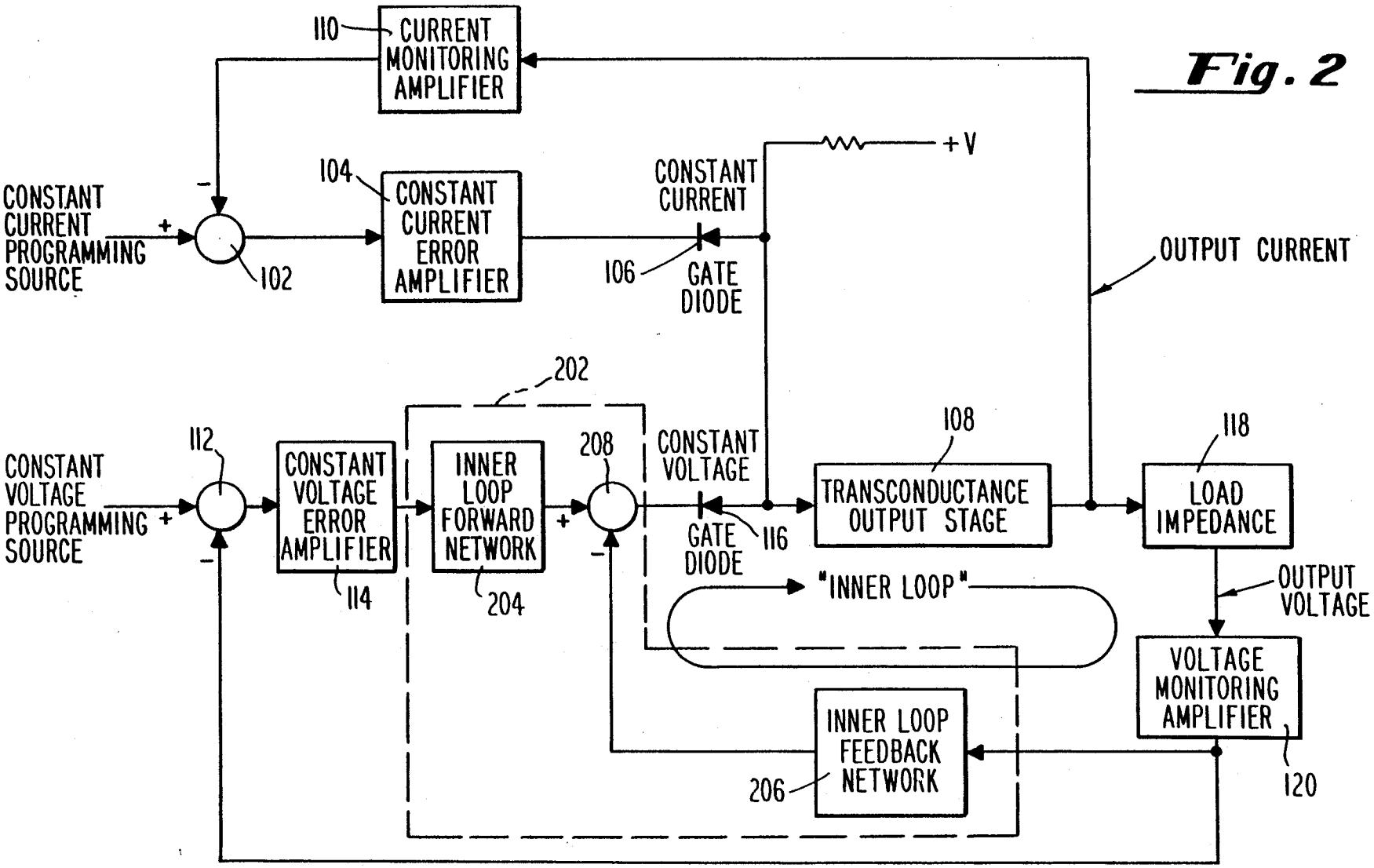
Fig. 2
OUTPUT CURRENT
LOAD IMPEDANCE
118
OUTPUT VOLTAGE
VOLTAGE MONITORING AMPLIFIER
120
TRANSCONDUCTANCE OUTPUT STAGE
108
"INNER LOOP"
INNER LOOP FEEDBACK NETWORK
206
+V
CONSTANT CURRENT
GATE DIODE
106
CONSTANT VOLTAGE
116
GATE DIODE
208
202
INNER LOOP FORWARD NETWORK
204
CURRENT MONITORING AMPLIFIER
110
CONSTANT CURRENT ERROR AMPLIFIER
104
CONSTANT VOLTAGE ERROR AMPLIFIER
114
102
112
CONSTANT CURRENT PROGRAMMING SOURCE
CONSTANT VOLTAGE PROGRAMMING SOURCE

POWER SUPPLY CONTROL CIRCUIT HAVING CONSTANT VOLTAGE AND CONSTANT CURRENT MODES

BACKGROUND OF THE INVENTION

1. Field oF the Invention

The present invention relates to a power supply control circuit for a power supply having constant current and constant voltage modes, and more particularly, to a power supply control circuit having a feedback network which renders the constant current and constant voltage control loop transfer functions simultaneously insensitive to the impedance of the power supply's load while still sharing a common output stage.

2. Description of the Prior Art

Power supplies having constant voltage (CV) and constant current (CC) modes are well known. However, prior art CV/CC power supplies generally have very broad dependencies between the power output stage and the control loops for the constant current and the constant voltage modes, and these dependencies greatly limit the performance of prior art power supplies. In other words, the design of prior art CV/CC power supplies invariably requires a balance of performance trade-offs associated with the output stage and the control loops of the power supply. Because of the costs associated with each of these circuit components, a good design has previously been one which trades off the benefits of each element with as little impact on cost and performance as possible. Unfortunately, these cost and performance trade-offs significantly limit how well the CV/CC power supply can operate in constant voltage or constant current mode.

An example of a prior art CV/CC power supply having a constant current preferred output stage is shown in FIG. 1. The CV/CC power supply of FIG. 1 generally includes a constant current control loop comprising elements 102–110 and a constant voltage control loop comprising elements 112–120. Both control loops include the output stage 108. During constant current operation of the circuit of FIG. 1, a constant current programming source supplies adder 102 with a predetermined constant current level at which a load connected to the output stage 108 is to be driven. The output of the adder 102 is amplified at constant current error amplifier 104 and then passed through a constant current gate diode 106 to drive the output stage 108. The output current detected at the output stage 108 is then fed back through current monitoring amplifier 110 to a negative input of adder 102 to form a negative feedback control loop. This control loop enables the current output of the output stage 108 to be maintained at the predetermined constant current level. Similarly, during constant voltage operation of the circuit of FIG. 1, a constant voltage programming source supplies adder 112 with a predetermined constant voltage level at which a load connected to the output stage 108 is to be driven. The output of the adder 112 is amplified at constant voltage error amplifier 114 and then passed through a constant voltage gate diode 116 to drive the output stage 108. The resulting output current flows through a load impedance 118 of the output circuitry, and the resulting output voltage is measured by voltage monitoring amplifier 120. The measured voltage is then fed back to a negative input of adder 112 to form a negative feedback control loop which enables the voltage across the load impedance 118 to be maintained at the predetermined constant voltage level.

Typically, CV/CC power supplies of the type shown in FIG. 1 have an output stage which favors either constant voltage operation or constant current operation. This ability to favor one mode of operation over another is defined by the output stage's ability to present at its output a voltage or current value fairly independent of the load impedance connected to the output stage while the input to the output stage is held constant. Hence, an output stage is classified as constant voltage preferred if when driven open loop from its input it exhibits the characteristics of a voltage source over that of a current source. Similarly, an output stage that when driven open loop from its input exhibits the characteristics of a current source is thought of as constant current preferred. The nature of this open loop transfer function of the output stage greatly influences the level of performance achievable by the constant current and constant voltage control loops in that output stage that are voltage preferred tend to yield excellent constant voltage performance but only moderate constant current performance due to the effects of the load impedance on the output of the output stage, while the opposite is true for output stages that are constant current preferred. However, these trade-offs between the two modes of operation of prior art power supplies are undesirable in that substantially ideal performance in both modes is inherently unattainable due to the adverse effects of the load impedance.

Since prior art CV/CC power supplies of the type shown in FIG. 1 generally trade-off the performance requirements by offering excellent performance in one mode but less than achievable performance in its other mode, application problems result because such power supplies are nevertheless expected to supply power both under constant voltage and constant current conditions and under a wide range of load conditions during operation. As a result, less than achievable performance of the power supply often results. Two basic approaches to the above problems have been used in prior art CV/CC power supplies. One approach has been to employ a constant voltage preferred output stage and to handle the constant current problems to the best extent possible. The other approach has been to start with a constant current preferred output stage and then to manage the constant voltage problems to the best extent possible. However, both of these prior art approaches have obvious limitations.

Because of the majority of applications requiring constant voltage operation, power supplies employing a constant voltage preferred output stage are commonly used in the prior art. These power supplies provide excellent constant voltage performance although the constant current loop can only be compensated to the extent possible to obtain limited performance in three major performance areas. These three areas are the ability to drive inductive loads, constant current recovery dynamics, and constant current noise performance. Unfortunately, when used with simple and inexpensive compensation schemes, these requirements tend to pull the design of the constant current control loop in two different directions. In prior art designs where the ability to drive highly inductive loads is pursued, the constant current control loop will tend to be compensated in a conservative fashion with very little bandwidth. This permits the constant current control loop to be more stable for inductive loads but also tends to yield a slow dynamic response in the time domain since when the power supply crosses over from constant voltage mode to constant current mode, the constant current loop which has been previously saturated must recover and slew back into regulation. A more sluggish compensation strategy for inductive loading will cause the constant current loop to recover slowly, during which time the output current of the power supply is unregulated and thus can damage sensitive loads by exceeding the constant current limit setting for a significant period of time.

Another problem with the constant voltage preferred approach is that high constant current output noise results, particularly excessive constant current RMS noise. The constant current RMS noise is also a result of the sluggish constant current loop compensation for inductive loading reasons. The constant current control loop thus tends to have less loop gain at nearly all frequencies and therefore makes it less capable of rejecting noise injected into the control loop from external noise sources. In addition, since the load impedance plays a significant role in the overall constant current loop gain, constant current performance can depend heavily on the actual load being driven. It is thus more difficult to specify constant current performance tightly without having to apply restricted load conditions. The constant current control loop thus has been dependent on the impedance of the load connected to the power supply.

As a result, previously it has been common practice to take a power supply employing a constant voltage preferred output stage that drives capacitive loads well and to heavily compensate its constant current loop in order to be able to drive highly inductive loads. However, although good results have been obtained in both modes for driving reactive loads, these results have been at the great expense of sluggish response when the supply is expected to rapidly cross-over from constant voltage mode to constant current mode under a load transition. Accordingly, it has taken a long period of time to get into constant current mode and/or a very large current overshoot has occurred causing possible damage to the load. As a result, prior art power supplies employing voltage preferred output stages typically have poorer inductive loading capabilities and have not enabled the full benefits of constant current mode operation to be achieved.

On the other hand, prior art power supplies which employ constant current preferred output stages typically drive inductive loads well inherently but may have a very large capacitance on their output. In particular, in prior art power supplies that employ constant current preferred output stages, the basic problem has been to deal with the variability of the load impedance presented to the output stage. In such prior art power supplies, there is a voltage gain from the input of the output stage to the output voltage of the power supply, and this voltage gain is directly dependent on the impedance of the load connected to the supply. A prior art proposal to eliminate the influence of the load impedance is to place a very low impedance, such as a large electrolytic capacitor, internal to the power supply but in parallel with the output terminals of the supply. This common technique stabilizes the output impedance for all loads where the load impedance is higher than that of the internal impedance. However, once such a capacitor has been chosen for the power supply design, it must be compensated for in the constant voltage control loop design. Thus, although this technique may solve the reactive loading problems, it forces the power supply to be slow with respect to up and down programming speed caused by the need to charge and discharge the large output capacitance.

As just noted, this approach has problems in that the output capacitor must be charged and discharged repeatedly in applications that require the output voltage of the supply to move between different values. The speed at which the output voltage can move depends on the size of the output capacitor and tends to make these power supplies slower than those with less output capacitance. Another drawback with this approach is that since the output capacitor is present all the time, it effectively lowers the output impedance when the power supply is in the constant current mode, which is less ideal. Moreover, the output capacitor itself is not an inexpensive or small component and adds significant cost to the power supply. Also, since there is non-negligible variability in the electrical parameters of the capacitor with respect to manufacturing tolerances, age and temperature, such variations must be taken into account in the worst case design of the control loop. The final worst case design will typically have degraded performance compared to a design that could have been less sensitive to this variability.

Furthermore, a large output capacitor has been a problem for some applications in the prior art due to its energy storage nature, for the larger the output capacitor, the more energy it stores. As a result, when a sudden load change occurs, all of the energy stored in the output capacitor can be dissipated in the load so as to cause damage, which is, of course, undesirable. Thus, the existence of the large capacitance has also led not only to increased cost but also to performance problems.

Accordingly, prior art power supplies have been unable to simultaneously meet a complete set of performance requirements for the constant voltage and constant current modes. Moreover, in accordance with the compensation strategies heretofore used, it has been inherently impossible to meet a complete set of performance requirements for both modes so that good performance may be achieved in the many possible combinations of subsets of the performance factors due to the interrelationship of the performance factors in both modes. A long-felt need in the art thus exists for a CV/CC power supply control circuit which enables the performance requirements in each mode to be met without the performance trade-offs which have been a problem in the prior art. The present invention has been designed to meet this need.

SUMMARY OF THE INVENTION

The above-mentioned long-felt need has been met in accordance with the present invention by adding a local feedback network in addition to the traditional CV/CC control loops. This local feedback network permits a more optimal synthesis of the two key transfer functions in the CV/CC power supply while still sharing a common output stage. These two transfer functions relate to the transfer from the output of a constant current error amplifier to the output current and to the transfer from the output of a constant voltage amplifier to the output voltage. By making both of these transfer functions simultaneously insensitive to the impedance of the load, a new degree of design freedom is created which can be used to reduce the performance trade-offs long inherent in prior art CV/CC power supplies.

A power supply control circuit in accordance with the invention controls a power supply operative in constant current and constant voltage modes. Preferably, such a control circuit in accordance with the invention comprises a first control loop for controlling the power supply during operation in one of the modes, a second control loop for controlling the power supply during operation in the other of the modes, an output stage having one of the modes as a preferred operating mode, and means for decoupling transfer functions of the control loops such that the power supply can perform in each of the modes independent of performance achieved in the other of the modes. Preferably, such decoupling means in accordance with the invention comprises a feedback loop from an output of the output stage which includes a series connection of an amplifier, a filter and a diode, where the diode is shared with a nonpreferred control loop which controls the power supply during operation in the mode other than the preferred operating mode and is connected so as to disable the nonpreferred control loop and the feedback loop when the preferred operating mode is selected. As a result, the preferred control loop never sees any ill effects that the feedback loop would present to operation in the preferred operating mode.

Preferably, the decoupling means of the invention further comprises means for allowing a signal fed back through the feedback loop to mimic a transfer function of an output stage having the nonpreferred mode as its preferred operating mode. Also, the transfer function of the output stage is transformed so as to be insensitive to an impedance of a load connected to an output thereof.

In accordance with another aspect of the invention, the power supply control circuit for controlling a power supply operative in constant current and constant voltage modes comprises a first control loop, having a first loop gain, for controlling the power supply during operation in one of the modes; a second control loop, having a second loop gain, for controlling the power supply during operation in the other of the modes; an output stage shared by the first and second control loops, the output stage having a transfer function associated therewith and a preferred operating mode; and means for decoupling the transfer function of the output stage such that the first loop gain has no effect on the second loop gain and the second loop gain has no effect on the first loop gain.

In accordance with yet another aspect of the invention, a power supply control circuit for a power supply having an output stage which is operative in constant current and constant voltage modes and which transforms an input signal thereto into an output signal substantially independent of the impedance of a load driven by the power supply comprises means for providing one of a predetermined constant current and a predetermined constant voltage value for a desired operating mode, a constant current control loop responsive to the predetermined constant current value and a current output of the output stage to maintain a constant current output at a level corresponding to the predetermined constant current value at the output stage, a constant voltage control loop responsive to the predetermined constant voltage value and a voltage across the load to maintain a constant voltage output at a level corresponding to the predetermined constant voltage value at the output stage, and feedback means for transforming a transfer function of the output stage in accordance with an impedance of the load such that the input signal is transformed by the output stage into an output signal independent of the impedance of the load.

Such feedback means preferably comprises a series connection of an amplifier, a filter and a diode, where the diode is shared with the constant voltage control loop and connected so as to disable the constant voltage control loop and the feedback means when the constant current mode is selected. In a preferred embodiment having a constant current preferred output stage, the output signal is fed back by the feedback means during the constant voltage mode so as to adjust the input signal to the output stage to simulate operation of the constant voltage loop as when a low impedance load is driven by the output stage.

The local feedback loop placed around the shared output stage in accordance with the invention thus allows a control loop to be synthesized for the mode that the output stage is least suited to handle, and by making the local feedback loop a part of one of the control loops, when the mode to which the output stage is best suited is selected, the local feedback loop can be disabled. As a result, optimum performance in the constant current and constant voltage modes is possible no matter what type of mode is preferred by the shared output stage.

BRIEF DESCRIPTION OF THE DRAWINGS

The objects and advantages of the invention will become more apparent and more readily appreciated from the following detailed description of the presently preferred exemplary embodiment of the invention taken in conjunction with the accompanying drawings of which:

FIG. 2 schematically illustrates a constant current/-constant voltage power supply control circuit in accordance with the invention.

DETAILED DESCRIPTION OF THE PRESENTLY PREFERRED EMBODIMENT

Figure 1:
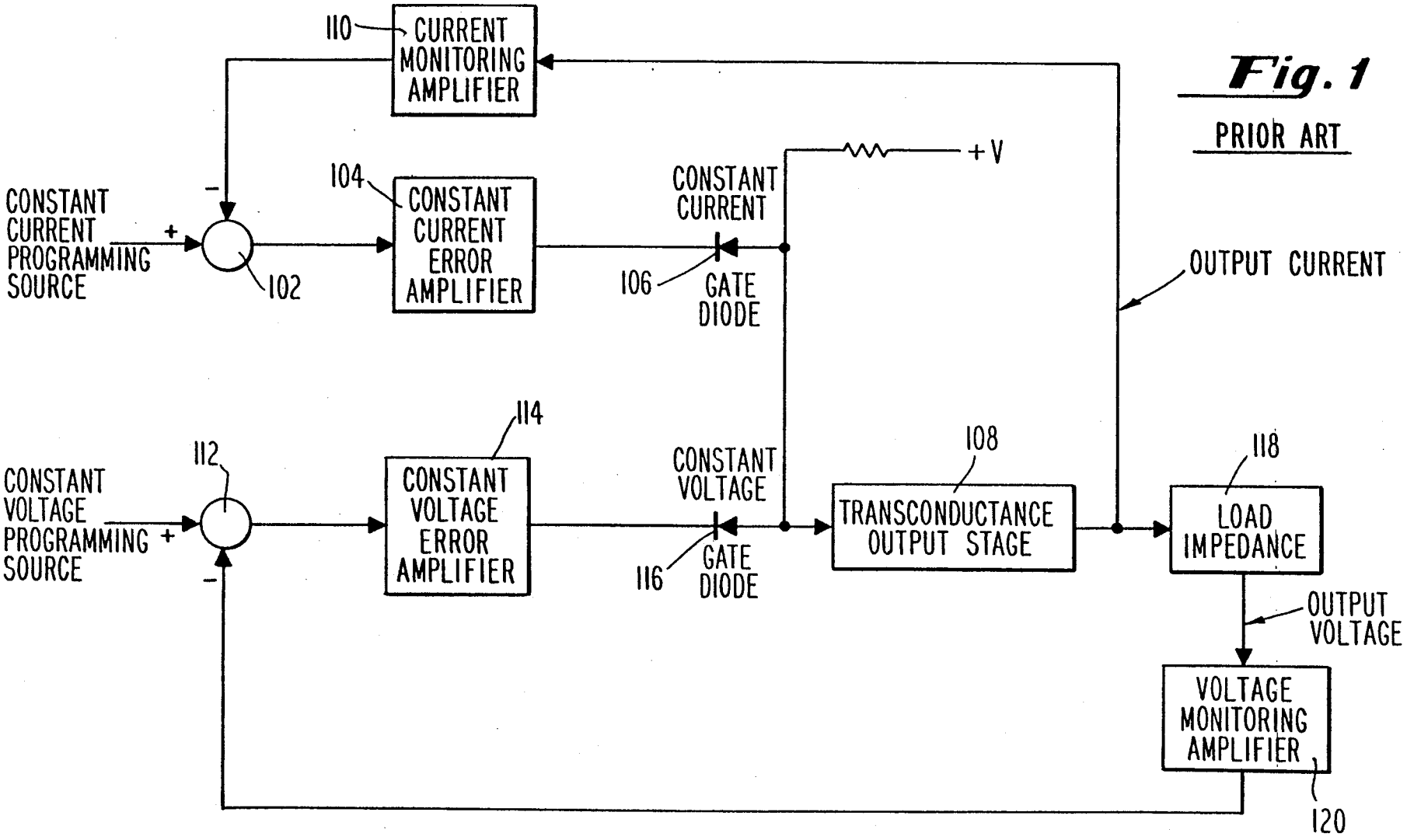
Fig. 1 PRIOR ART
FIG. 1 schematically illustrates a constant current/-constant voltage power supply control circuit of the prior art.

The inventor of the subject matter disclosed and claimed herein has satisfied the above-mentioned long-felt need in the art by developing a power supply control circuit which feeds back one of the outputs of the power supply to a point which permits the feedback loop to form a better foundation on which to synthesize a control loop for the mode in which the output stage is least suited. The feedback loop of the invention also makes the constant current and constant voltage control loops insensitive to variations in either the output stage's transfer function or the load impedance. As a result, the present invention makes independent the achievable performance of the constant voltage and constant current control loops.

A device with these and other beneficial features in accordance with a presently preferred exemplary embodiment of the invention will be described below with respect to FIGS. 2 and 3, where like reference numerals correspond to like elements throughout the figures. It will be appreciated by those of ordinary skill in the art that the description given herein is for exemplary purposes only and is not intended in any way to limit the scope of the invention. All questions regarding the scope of the invention may be resolved by referring to the appended claims.

As shown in FIG. 2, the present invention primarily differs from the prior art control circuit of FIG. 1 in that a feedback circuit 202 including an inner loop forward network 204, an inner loop feedback network 206 and an adder 208 is provided. Feedback circuit 202 of FIG. 2 is shown for a presently preferred embodiment where the output stage is constant current preferred. For the embodiment shown, feedback circuit 202 is disposed as a local control loop or "inner loop" with respect to the constant voltage control loop and the output stage 108. However, as would be apparent to one of ordinary skill in the art, feedback circuit 202 may also be disposed as an "inner loop" with respect to the constant current control loop for an output stage which is constant voltage preferred. Moreover, feedback circuit 202 may be disposed as an "inner loop" in both the constant current and constant voltage control loops. Hence, although the invention is described for an output stage which is constant current preferred, this mode is illustrated only for exemplary purposes and is not intended to limit the scope of the invention.

In the embodiment of FIG. 2, transconductance output stage 108 regulates its output current without regard to its output voltage when driven open loop from its input. Hence, a small signal transfer function of output stage 108 from its input signal to output current is very insensitive to the load impedance connected to it. As a result, the compensation of the constant current control loop is very straightforward since it lacks the variability of the transfer function with respect to the output voltage, output current or load impedance. Thus, the compensation in the constant current control loop may be freely set without consideration of the output impedance as in the prior art.

However, in compensating the constant voltage loop, the small signal transfer function of the output stage 108 from input signal to output voltage is extremely dependent on the impedance connected to it. It is this dependency of the voltage transfer function on load impedance that causes compromised constant voltage performance as in the prior art unless the control loop is modified. This modification is made in accordance with the present invention by adding the aforementioned feedback circuit 202 to form an "inner loop" feedback network which is local to output stage 108. As previously mentioned, the "inner loop" may be disposed with respect to the constant voltage control loop for a constant current preferred output stage 108 or with respect to the constant current control loop for a constant voltage preferred output stage 108.

The amount, nature and topology of the feedback provided by this "inner loop" are all key to the performance of the power supply. For example, the nature of the feedback of the "inner loop" is such that the constant voltage error amplifier 114 sees the closed loop transfer function of the "inner loop" that mimics a voltage preferred output stage driving a low impedance load. This prevents the constant voltage control loop from being overly concerned with load impedance variations. In other words, load impedance variations that would have affected the loop gain of the constant voltage control loop show up as affecting the loop gain of the "inner loop" only. The closed loop response of the "inner loop", which is of concern to the constant voltage control loop, remains unaffected.

The amount of feedback through the "inner loop" is controlled to guarantee no loop-to-loop large signal oscillation provoked by load transients. Also, the bandwidth of the "inner loop" is limited so that under remote sensing conditions parasitic phase shift from the output voltage to the remote sensing location cannot cause the "inner loop" to become unstable. For example, inner loop feedback network 206 may include a high pass filter which passes signals above a predetermined frequency but limits the passage of signals less than the predetermined frequency. One benefit of these conditions placed on the "inner loop" is that it eliminates the possibility of local output stage oscillations common to passive emitter-follower output stages, where large amounts of feedback local to the output stage produce the necessary bandwidth required for pass transistor oscillation.

In addition, the "inner loop" accomplishes the necessary task of providing the proper altering of the output stage transfer function only while in the constant voltage mode. The "inner loop" is automatically disabled by the constant current control loop when the power supply enters the constant current mode by forcing off the constant voltage gate diode 116. In other words, since the constant voltage gate diode 116 is in the series path of the "inner loop", it effectively disables the constant voltage control loop as well as the "inner loop". Hence, when the constant current control loop is in control, output stage 108 once again takes on its current preferred attributes, and the constant voltage control loop is decoupled from the constant current control loop.

The present invention thus divorces the output of the output stage 108 from other influences so as to avoid the adverse effects on the output caused by varying load impedances. Also, since the constant current and constant voltage control loops are kept separate, the performance trade-offs of the prior art are not present. Moreover, since the "inner loop" is disabled during constant current operation, the loop gain equations of the constant current feedback loop and the constant voltage feedback loop are independent of each other as are the resulting transfer functions. In other words, there is no coupling between the transfer functions of the loop gains of the constant current and constant voltage control loops. This is so because the constant current and constant voltage control loops never have to share directly a block of circuits that tends to favor one control loop's performance over the other. Furthermore, by positioning output stage 108 and the load impedance 118 in the forward path of the "inner loop," the closed loop response of the "inner loop" is made insensitive to variations in either the output stage's transfer function or the load impedance. The compensation of the constant voltage loop is thus independent of the compensation of the constant current loop so as to allow substantial flexibility and high performance during both modes of control.

The "inner loop" of the invention allows its feedback to shape the transfer function of the constant voltage control loop so as to mimic a voltage preferred output stage driving a low impedance load by providing an inner loop feedback network 206 having a transfer function which transforms the closed loop transfer function from the constant voltage error amplifier 114 to the output voltage of output stage 108 so that the desired output voltage is obtained. In other words, inner loop feedback network 206 presents constant voltage error amplifier 114 with a transfer function which is suitable for synthesizing a high performance constant voltage control loop. Inner loop forward network 204 works in conjuction with the inner loop feedback network 206 to shape the transfer function of the output stage in this manner. As would be apparent to one skilled in the art, the circuitry of inner loop forward network 204 may be incorporated into the error amplifier immediately preceding it.

Figure 3:
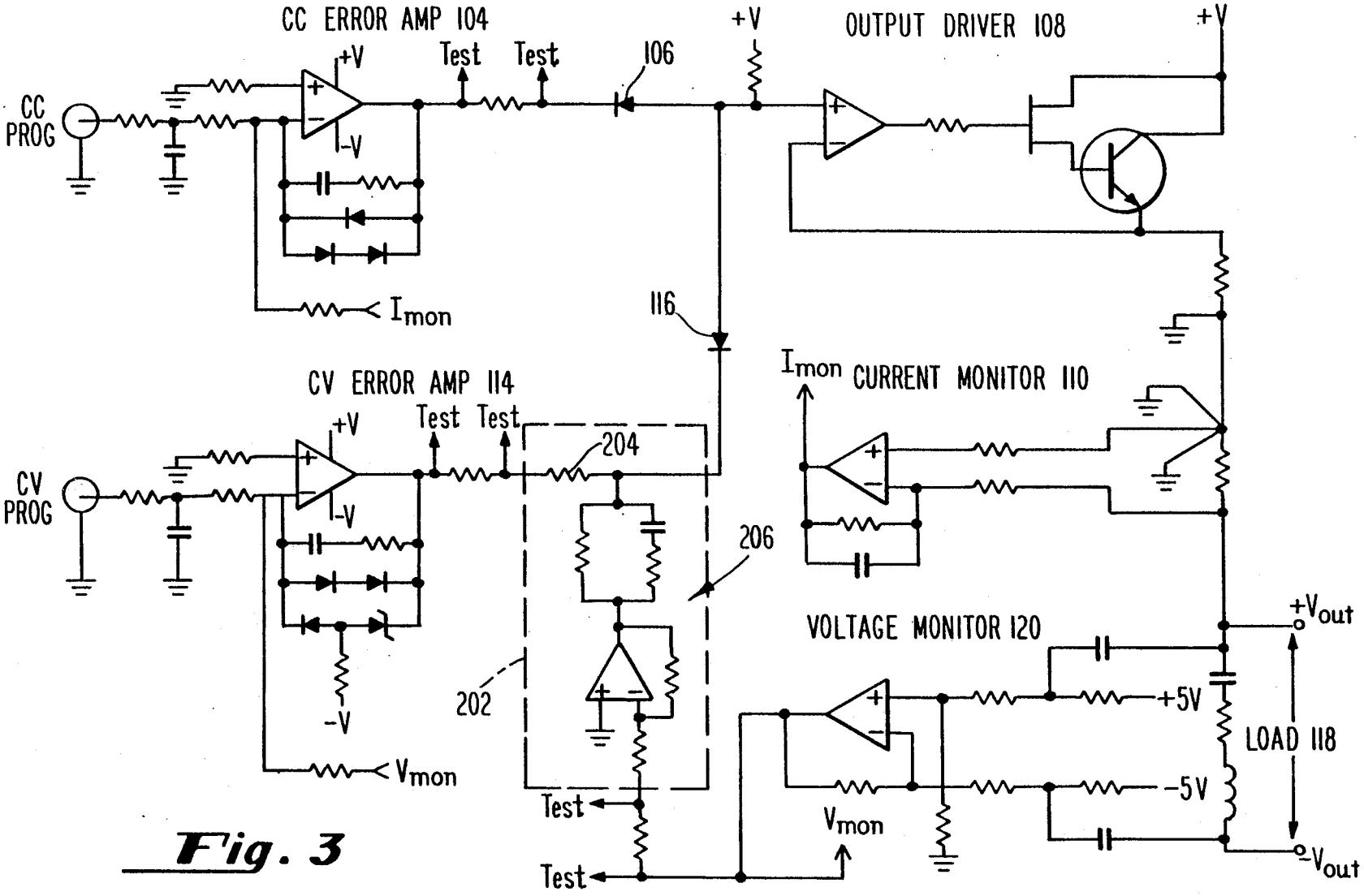
FIG. 3 schematically illustrates a detailed circuit diagram of a preferred embodiment of the power supply control circuit of FIG. 2.

FIG. 3 illustrates a detailed schematic diagram of a presently preferred embodiment of the circuit of FIG. 2. As shown, the "inner loop" may include an inverting amplifier connected in series with a filter which is, in turn, connected to the cathode of diode 116, where the resulting signal is subtracted from the signal received from the inner loop forward network 204. As shown, the inner loop forward network 204 may be a simple resistor. As noted above, since the feedback of the "inner loop" is inserted before the constant voltage gate diode 116, the closed loop transfer function of the "inner loop" has no ill effect on the loop gain of the constant current loop since the constant voltage gate diode 116 disables the "inner loop" during constant current operation. Moreover, since the impedance variations only affect the loop gain of the "inner loop" and do not affect the constant voltage control loop, all the benefits of the constant voltage output mode may be obtained even for a power supply having a constant current preferred output stage.

The present invention thus enables the CV/CC power supply of a preferred embodiment of the invention to topologically favor constant current operation without making it difficult or costly to achieve high performance in its constant voltage mode of operation. Moreover, since a large capacitance is not required for handling the effects of impedance variations on the output, faster voltage programming response is achievable without giving up reactive loading capability in constant voltage mode. Thus, high inductive loads may be driven in the constant current mode, while high capacitive loads may be driven in the constant voltage mode. Both modes in accordance with the invention thus can exhibit low output noise and small over/under shoots during mode crossover. Full benefits of each of the modes of operation are hence attainable in accordance with the present invention.

Although an exemplary embodiment of the invention has been described in detail above, those skilled in the art will readily appreciate that many additional modifications are possible in the exemplary embodiment without materially departing from the novel teachings and advantages of the invention. For example, as previously noted, the feedback loop of the invention may be disposed with respect to the constant current and/or the constant voltage control loops in accordance with the mode of operation preferred by the output stage. In addition, the present invention may be used in an electronic load device by replacing the load impedance as herein defined with a series connection of a source of power and the load to be driven. Accordingly, all such modifications are intended to be included within the scope of this invention as defined in the following claims.

I claim:

1. A power supply control circuit for a power supply operative in constant current and constant voltage modes, comprising:

a first control loop for controlling said power supply during operation in one of said modes;

a second control loop for controlling said power supply during operation in the other of said modes;

an output stage having one of said modes as a preferred operating mode; and means for decoupling transfer functions of said control loops such that said power supply can perform in each of said modes independent of performance achieved in the other of said modes.

2. A control circuit as in claim 1, wherein said decoupling means comprises a feedback loop from an output of said output stage, said feedback loop comprising a series connection of an amplifier, a filter and a diode, said diode being shared with a nonpreferred control loop which controls said power supply during operation in the mode other than said preferred operating mode and being connected so as to disable said nonpreferred control loop and said feedback loop when the preferred operating mode is selected.

3. A control circuit as in claim 2, wherein said decoupling means further comprises means for allowing a signal fed back through said feedback loop to mimic a transfer function of an output stage having the nonpreferred mode as its preferred operating mode.

4. A control circuit as in claim 1, wherein a transfer function of said output stage is insensitive to an impedance of a load connected to an output thereof.

5. A power supply control circuit for a power supply operative in constant current and constant voltage modes, comprising:

a first control loop, having a first loop gain, for controlling said power supply during operation in one of said modes;

a second control loop, having a second loop gain, for controlling said power supply during operation in the other of said modes;

an output stage shared by said first and second control loops, said output stage having a transfer function associated therewith and one of said modes as a preferred operating mode; and means for decoupling the transfer function of said output stage such that said first loop gain has no effect on said second loop gain and said second loop gain has no effect on said first loop gain.

6. A control circuit as in claim 5, wherein said decoupling means comprises a feedback loop from an output of said output stage, said feedback loop comprising a series connection of an amplifier, a filter and a diode, said diode being shared with a nonpreferred control loop which controls said power supply during operation in the mode other than said preferred operating mode and being connected so as to disable said nonpreferred control loop and said feedback loop when the preferred operating mode is selected.

7. A control circuit as in claim 6, wherein said decoupling means further comprises means for allowing a signal fed back through said feedback loop to mimic a transfer function of an output stage having the nonpreferred mode as its preferred operating mode.

8. A control circuit as in claim 5, wherein said transfer function of said output stage is insensitive to an impedance of a load connected to an output thereof.

9. A power supply control circuit for a power supply having an output stage which is operative in constant current and constant voltage modes and which transforms an input signal thereto into an output signal for application to a load driven by said power supply, comprising:

means for providing one of a predetermined constant current and a predetermined constant voltage value for a desired operating mode;

a constant current control loop responsive to said predetermined constant current value and a current output of said output stage to maintain at an output of said output stage a constant current at a level corresponding to said predetermined constant current value;

a constant voltage control loop responsive to said predetermined constant voltage value and a voltage across said load to maintain at said output of said output stage a constant voltage at a level corresponding to said predetermined constant voltage value; and feedback means for feeding back said output signal of said output stage to an input of said output stage so as to transform a transfer function of said output stage in accordance with an impedance of said load such that said input signal to said output stage is transformed by said output stage into an output signal independent of the impedance of said load.

10. A control circuit as in claim 9, wherein said feedback means comprises a series connection of an amplifier, a filter and a diode said diode being shared with said constant voltage control loop and connected so as to disable said constant voltage control loop and said feedback means when the constant current mode is selected.

11. A control circuit as in claim 10 wherein said output signal is fed back by said feedback means during said constant voltage mode so as to maintain said input signal to said output stage constant and to simulate operation of said constant voltage loop as when a low impedance load is driven by said output stage.

12. A power supply control circuit for a power supply having an output stage which is operative in constant current and constant voltage modes and which transforms an input signal thereto into an output signal for application to a load driven by said power supply, comprising:

means for providing one of a predetermined constant current and a predetermined constant voltage value for a desired operating mode;

a constant current control loop responsive to said predetermined constant current value and a current output of said output stage into said load for maintaining a constant current into said load at a level corresponding to said predetermined constant current value;

a constant voltage control loop responsive to said predetermined constant voltage value and a voltage output of said output stage across said load for maintaining a constant voltage across said load at a level corresponding to said predetermined constant voltage value; and feedback means responsive to said output signal of said output stage for holding said input signal to said output stage constant in accordance with said load impedance such that said input signal is transformed by said output stage and said load impedance into an output signal independent of said load impedance.

13. A control circuit as in claim 12, wherein said constant current and constant voltage control loops each include a gate, each gate being disposed such that a gate in an operational control loop is closed while a gate in a nonoperational control loop is opened, thereby enabling said constant current and constant voltage control loops to control said output stage independent of each other.

14. A control circuit as in claim 13, wherein said feedback means includes one of said gates, whereby when said one gate is disabled, said feedback means is also disabled.

* * * * *